US007713025B2

(12) United States Patent
Chen et al.

(10) Patent No.: US 7,713,025 B2
(45) Date of Patent: May 11, 2010

(54) ASSEMBLING MEMBER

(75) Inventors: Hsiao-Liang Chen, Banciao (TW); Hui-Ting Chang, Sinjhuang (TW); Chun-I Li, Jhonghe (TW)

(73) Assignee: Micro-Star Int'l Co., Ltd., Jung-He (TW)

( * ) Notice: Subject to any disclaimer, the term of this patent is extended or adjusted under 35 U.S.C. 154(b) by 586 days.

(21) Appl. No.: 11/535,421

(22) Filed: Sep. 26, 2006

(65) Prior Publication Data

US 2008/0075589 A1 Mar. 27, 2008

(51) Int. Cl.
*F01D 25/26* (2006.01)

(52) U.S. Cl. ..... 415/213.1; 415/214.1

(58) Field of Classification Search ..... 415/213.1, 415/214.1, 220; 361/695
See application file for complete search history.

(56) References Cited

U.S. PATENT DOCUMENTS 6,592,327 B2 * 7/2003 Chen et al. ..... 415/213.1
7,048,498 B2 * 5/2006 Kosugi ..... 415/118
7,172,390 B2 * 2/2007 Lu et al. ..... 415/213.1
7,304,843 B2 * 12/2007 Peng et al. ..... 361/687
7,450,379 B2 * 11/2008 Chen et al. ..... 361/695

FOREIGN PATENT DOCUMENTS

TW M285896 1/2006

* cited by examiner

*Primary Examiner*—Edward Look
*Assistant Examiner*—Ryan H Ellis
(74) *Attorney, Agent, or Firm*—Workman Nydegger

(57) ABSTRACT

An assembling member disposed on a heatsink fan in pairs for detachably disposing the heatsink fan on a fixed frame is provided. The assembling member includes a jointing part and an operating part. The jointing part matches with the fixed frame, and extends a plurality of fastening pins capable of being hooked at the assembly holes of the heatsink fan. The operating part is extended from one end of the jointing part, and passed and grasped by human fingers, so as to hook the jointing part on the heatsink fan. Thus, the heatsink fan is mounted on the fixed frame only by hooking the operating part through human fingers.

6 Claims, 4 Drawing Sheets

ASSEMBLING MEMBER

BACKGROUND OF THE INVENTION

1. Field of Invention

The present invention relates to an assembling member, and more particularly to an assembling member jointed to a heatsink fan frame and used for assembling a heatsink fan on a fixed frame.

2. Related Art

With the rapid development of high-tech industries such as computer information and the wide expansion of the application range, the requirements for data processing speed of electronic elements within the computer, such as Central Processing Unit (CPU) and Hard Disk Drive (HDD) are correspondingly increased. The volume of the electronic element tends to be miniaturized, and the intensity per unit area is increasingly higher. As the calculation speed of the computer increases, the heat generated by the relevant electronic elements also increases. If the heat is not dissipated in time, the temperature becomes excessively high, thus electron ionization, heat stress and the like occur for the electronic elements, thereby severely influencing the stability and efficiency of computer operation, and reducing the life time of the electronic element. Therefore, a heatsink fan must be mounted within the computer, in order to dissipate heats for electronic elements in the computer and reduce the temperature.

A conventional heatsink fan has a fixing hole on each of the four corners respectively, and the heatsink fan is locked on the computer case by passing screws through the fixing holes. When the heatsink fan is maintained or assembled, the screws must be detached one by one, which is rather complicated and time-consuming. Especially, as for the computer equipments used in industry, such as server/work station, there is large number of electronic elements, and the heat generated therein is far higher than that of a common personal computer (PC), such that a plurality of heatsink fans must be assembled for heat dissipation. If the heatsink fans are fixed with screws, the assembling process is more time-consuming as the number of screws significantly increases. When the heatsink fans need to be maintained and replaced, the operation of the server must be stopped and the whole server must be detached, thereby influencing the operation efficiency of the server.

In order to solve the above problem, a fixing device for fixing a fan within a base of an electronic device is disclosed in Publication No. M285896 of Taiwan Patent Gazette filed on Jan. 11, 2005 and entitled Mounting Apparatus for Fans, wherein a fixing part is mounted on the fan to fix the fan on a mounting frame of the base. The fixing part is provided with an operating part and a stopper respectively, wherein the stopper is clipped to a clipping hole corresponding to the mounting frame to be fixed on the mounting frame. If the fan is intended to be detached, it only needs to press the two operating parts internally to generate a flexible deformation, such that the stopper of the fixing part is disengaged from the clipping hole of the mounting frame, and then the operating parts are pulled upwards, thus, the fan is detached from the mounting frame and it can be taken out without any other tools.

As for the fan fixing device disclosed in Taiwan Patent No. M285896, although the complicated process for assembling the heatsink fan is simplified, and the assembling and detaching time for mounting or replacing the heatsink fans is reduced, there are still some inconveniences in mounting the heatsink fan. The restriction lies in that, the specification of the fixing part for the heatsink fan must be matched with that of the heatsink fan, otherwise, the heatsink fan cannot be fixed on the fixing part smoothly. The tolerance error generated during the manufacturing process also becomes a factor for negatively influencing the mounting of the heatsink fan, and if the specification of the heatsink fan and the mounting part are not matched with each other, the two cannot be jointed and fixed with each other.

Another problem of the fan fixing device disclosed in the prior art lies in that, the appearance of the fixing part is a symmetric rectangular structure, and the appearance of the heatsink fan is similar to that of the fixing part, thus, when a user fixes the heatsink fan on the fixing part, he/she must focus on the mounting direction of the heatsink fan, that is, if the end surface of the heatsink fan having blades is disposed towards a wrong direction, the heat dissipation effect cannot be achieved at all.

The fan fixing device in the prior art has a mounting part directly protruding from the fixing part to be fitted with the fixing hole of the heatsink fan. However, since the fixing part has no space for flexible adjustment, the mounting part is not easily detached from the fixing hole, and the fixing part is tightly jointed with the operating part, such that the flexibility margin of the fixing part is poor. As a result, when the heatsink fan is displaced or maintained, a lot of time is wasted on detaching the fan fixing device fixed on the heatsink fan, and if a force is applied improperly, the fixing part of the fan fixing device is likely to be broken and damaged, which is quite inconvenient.

SUMMARY OF THE INVENTION

In view of the above problems, it is an object of the present invention to provide an assembling member, which is used for alleviating the limitations and defects in the prior art that the heatsink fan and the fixing part cannot be fixed to each other since their specifications are not matched with each other, and that the heatsink fan is easy to be disposed towards a wrong direction since the heatsink fan and the fixing part have similar appearance and structure.

The assembling member disclosed in the present invention is disposed on two opposite sides of a heatsink fan in pairs, and the heatsink fan is detachably disposed on a fixed frame. The assembling member disclosed in the present invention comprises: a jointing part having at least one flexible end disposed on one side for providing a flexible deformation range for the jointing part; an operating part, formed by extending and bending one side of the jointing part, wherein a gap is opened at one end of the operating part, so as to provide a space for fingers to pass through and grasp; and a plurality of fastening pins, formed by extending the jointing part, wherein a protruding shaft is disposed on one end of a fastening pin to be hooked in an assembly hole corresponding to the fan frame.

In the assembling member disclosed in the present invention, the flexible end of the jointing part has a guide slot. When the jointing part is disposed in the fixed frame and is pressed, a flexible space is provided, thus when the heatsink fan is mounted on fixed frames with different sizes, a flexible deformation range is provided, such that the heatsink fan can be mounted on the fixed frame smoothly.

In addition, the fastening pins provide the assembling member fixed on the heatsink fan with a bonding strength. Since the fastening pins are formed by extending the jointing part, they can be flexibly adjusted, such that the assembling member fixed on the heatsink fan is easily detached, thus alleviating the defect in the prior art that the fan fixing device is not easily detached from the heatsink fan.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

The assembling member disclosed in the present invention is mounted on a heatsink fan to fix the heatsink fan in a fixed frame of an electronic element. The above-mentioned electronic element includes, but not limited to, PC, Server, and the like. In the detailed description of the present invention below, the fixed frame of a server is taken as the most preferred embodiment in the present invention. However, the accompanying drawings are provided only for reference and demonstration, but not to limit the present invention.

Figure 1A:
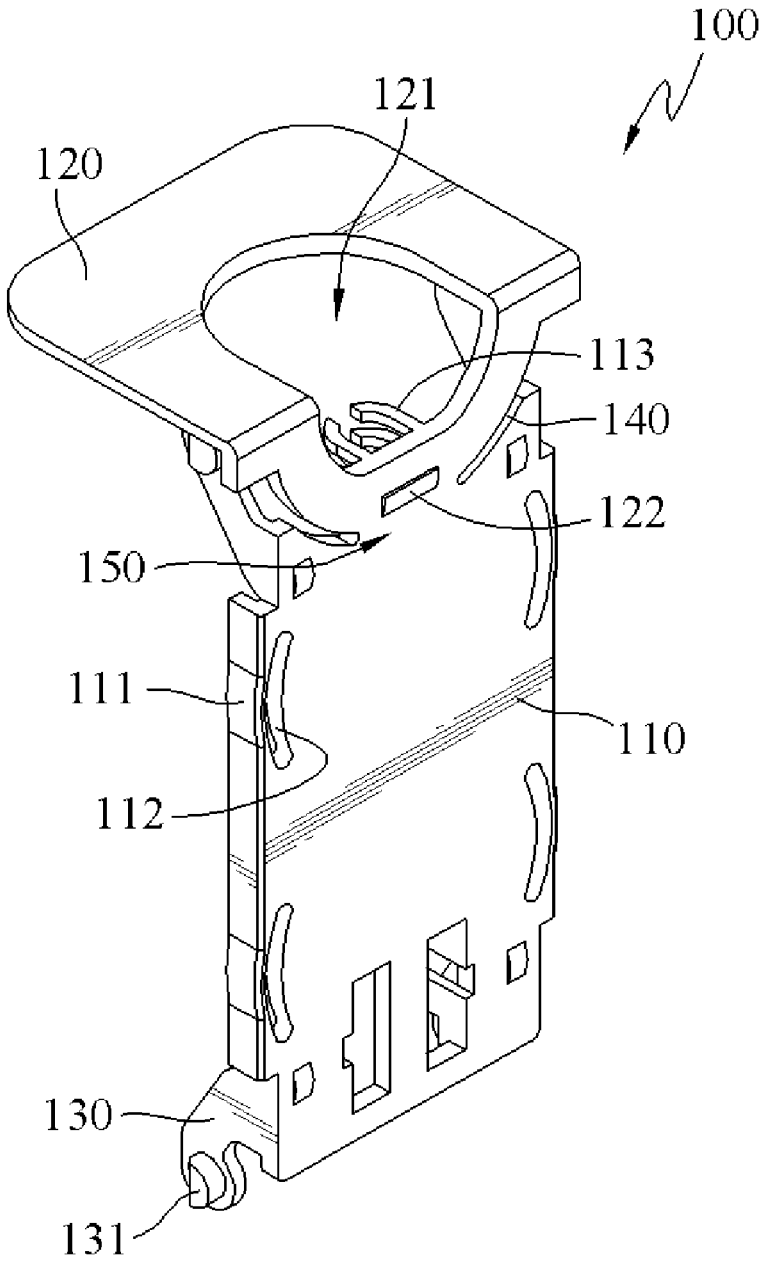
FIG. 1A is an enlarged view of one side of an assembling member according to the present invention.

FIG. 1A is an enlarged view of one side of an assembling member 100 according to the present invention. As shown in the FIG. 1A, the assembling member 100 comprises a jointing part 110, an operating part 120, and a plurality of fastening pins 130. The jointing part 110 has an appearance of a long plate-shaped structure made of plastic materials, and at least one flexible end 111 is disposed on two opposite long sides of the jointing part 110 respectively, for providing the jointing part 110 with a flexible deformation range. The operating part 120 is formed by extending and bending a short side of the jointing part 110, and a gap 121 is opened at the operating part 120 to provide a space for fingers to pass through and grasp. The plurality of fastening pins 130 is formed by extending the long side of the jointing part 110 towards the bending direction of the operating part 120, and a protruding shaft 131 is disposed at one end of the fastening pin 130. As for the fastening pins 130 disclosed in the present invention, four opposite fastening pins 130 are extended from two long sides of the jointing part 110. Those skilled in the art can also make modifications of extending a plurality of fastening pins 130 from the jointing part 110, which is not limited to this embodiment.

Figure 1B:
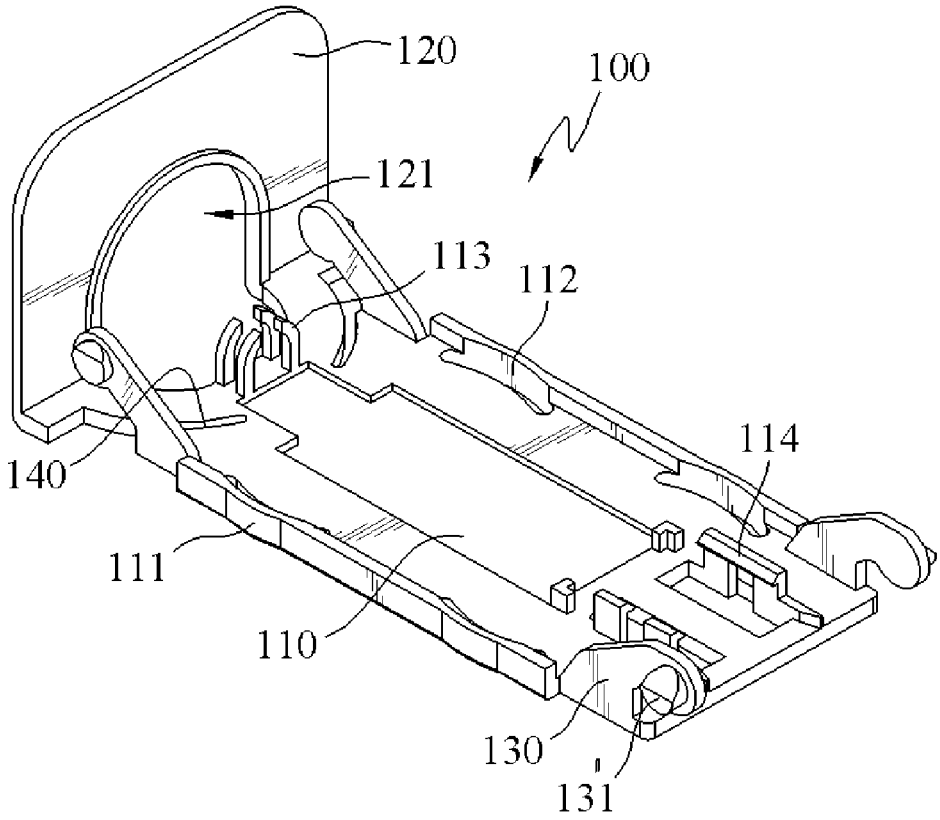
FIG. 1B is an enlarged view of another side of an assembling member according to the present invention.
Figure 2:
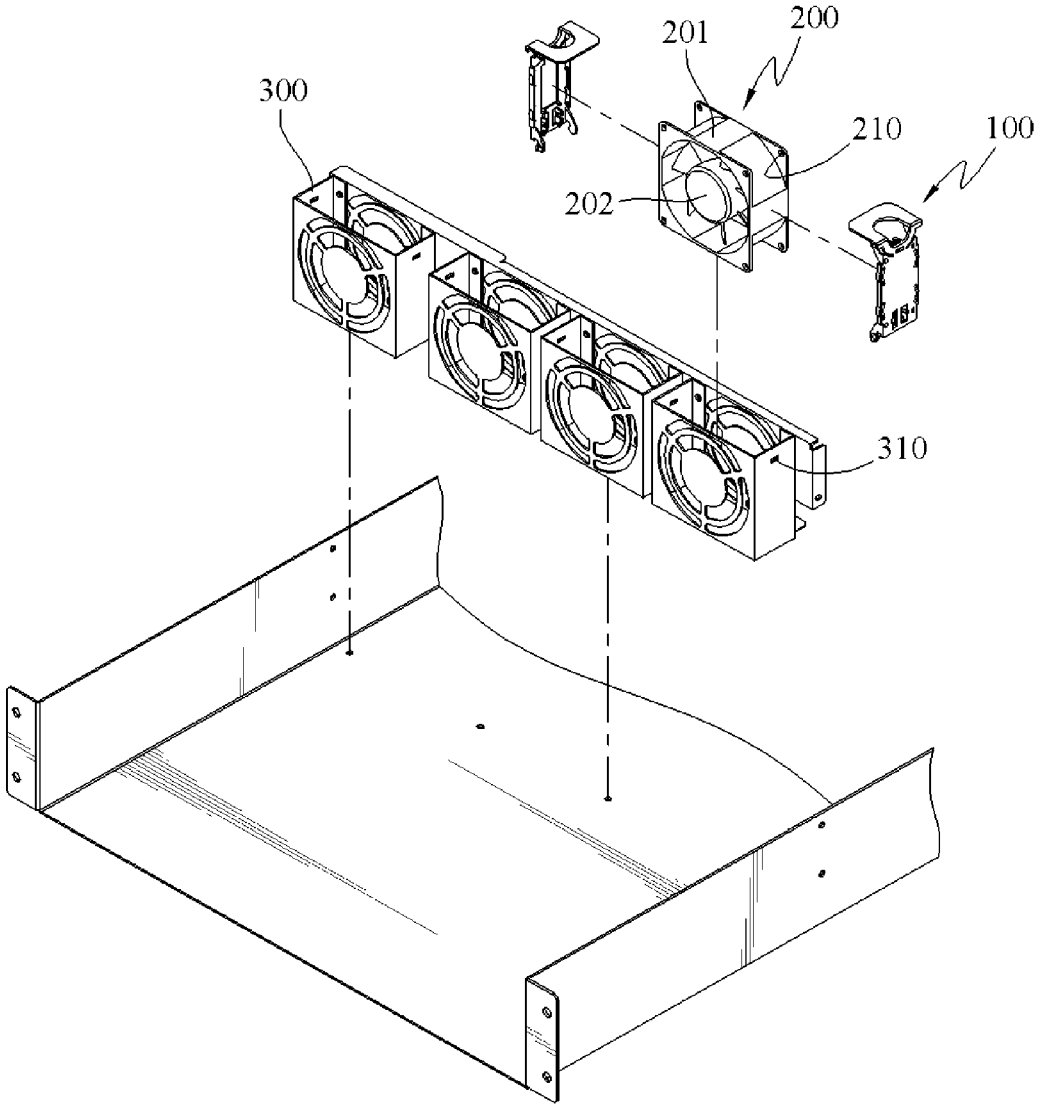
FIG. 2 is an exploded schematic view of the present invention.

As shown in FIG. 1B and FIG. 2, the heatsink fan 200 is formed by disposing a fan blade 202 within a fan frame 201. The assembling member 100 disclosed in the present invention is disposed on two opposite sides of a heatsink fan 200 in pairs, so as to detachably dispose the heatsink fan 200 on a fixed frame 300. A display lamp socket 113 and a snapping slot 114 are disposed on one side of the jointing part 110 for the assembling member 100 corresponding to the heatsink fan 200. The display lamp socket 113 is used for accommodating a display lamp (not shown) of the heatsink fan 200, and the snapping slot 114 is used for snapping an electronic element (not shown). The protruding shafts 131 on one end of the plurality of fastening pins 130 formed by extending the jointing part 110 are used for being hooked at a set of assembly holes 210 on opposite sides of the fan frame 201, such that the assembling member 100 fixed in the heatsink fan 200 has a bonding strength. The fastening pins 130 are formed by extending the jointing part 110, such that they have the characteristic of flexibility, thus, the assembling member 100 is easily detached from the heatsink fan 200, and both the bonding strength of the assembling member 100 and the convenience for the user to detach the assembling member are considered. Moreover, the purpose for designing the fastening pins 130 lies in that, when the assembling member 100 is mounted on a heatsink fan 200 with a different size, a part of the errors in mounting size is tolerable. The protruding shaft 131 disposed on the fastening pins 130 is of a semicircular shape with an inclined surface, and when it is mounted in the assembly hole 210, some size errors are also tolerable.

The fixed frame 300 may be a fixed frame 300 of a server or a PC, but not limited to this. The two assembling members 100 disposed on the heatsink fan 200 in pairs have different sizes, such that the heatsink fan 200 having the pair of assembling members 100 only can be disposed in the fixed frame 300 in a fixed direction, thus avoiding the circumstance that the user places the heatsink fan 200 towards a wrong heat dissipation direction of the fan, and as a result, the heat dissipation effect cannot achieved for the heatsink fan 200.

Figure 3:
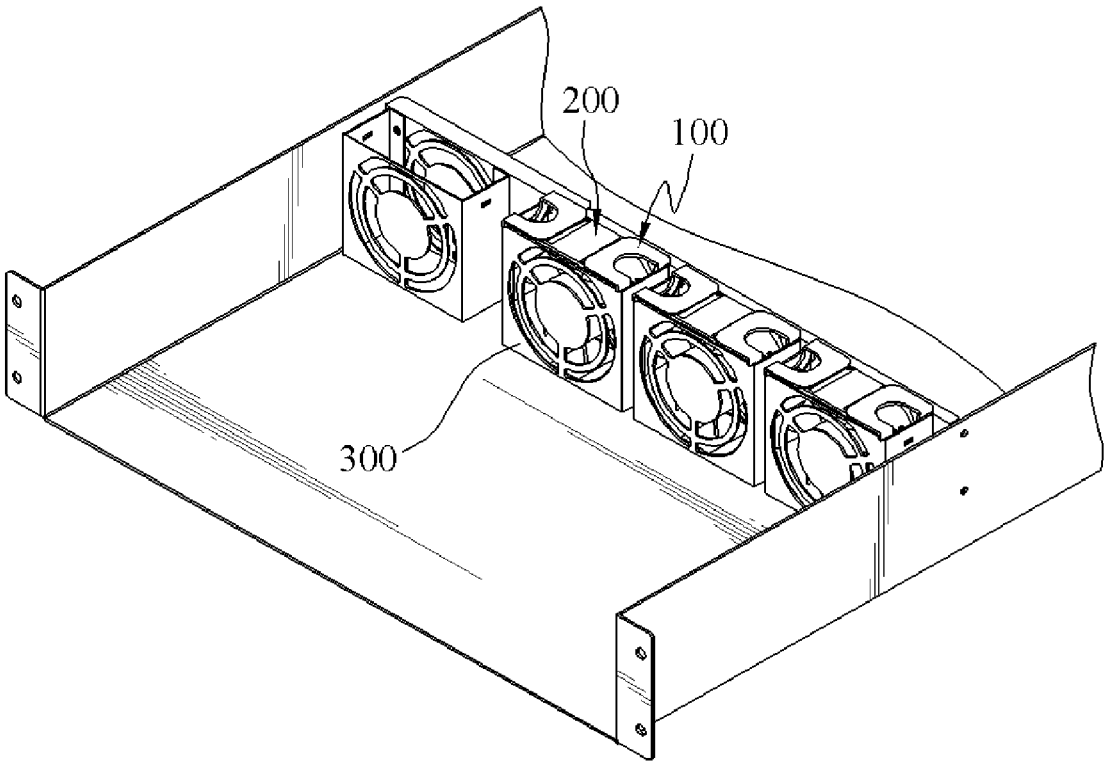
FIG. 3 is an assembled schematic view of the present invention.

As shown in FIG. 1A, FIG. 2, and FIG. 3, the heatsink fan 200 having the assembling members 100 is disposed within the fixed frame 300 in a fixed direction. The assembling member 100 has a guide slot 112 at the flexible end 111. When the jointing part 110 is pressed due to the size differences between the heatsink fan 200 and the fixed frame 300 resulted from different specifications or tolerances there-between, the guide slot 112 provides a flexible space for the jointing part 110, such that the jointing part 110 has a flexible deformation range, and the heatsink fan 200 can be mounted in the fixed frame 300 smoothly. The operating part 120 is provided with two symmetric grooves 140 on both side-cutting edges, and the grooves 140 contracts towards the direction of the jointing part 110 in shape to form a neck portion 150, such that the operating part 120 has desirable flexibility and deformation characteristics. An embedded block 122 is further disposed on the neck portion 150 of the operating part 120 corresponding to one side of the fixed frame 300, and is embedded with an embedded hole 310 corresponding to the fixed frame 300, such that the heatsink fan 200 is bonded on the fixed frame 300.

When the heatsink fan 200 is to be detached from the fixed frame 300, it only needs to pull the operating part 120 for the pair of the assembling members 100 disposed on the heatsink fan 200 towards upward, such that the flexible operating part 120 is flexibly deformed. As a result, the embedded block 122 of the neck portion 150 is disengaged from the embedded hole 310 of the fixed frame 300, thereby the heatsink fan 200 is taken out of the fixed frame 300.

The efficacy of the present invention lies in providing a mounting margin for the heatsink fan, preventing the user from disposing the heatsink fan in a wrong direction, and making the assembling member be easily detached.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An assembling member, disposed on two opposite sides of a heat sink fan in pairs, so as to detachably dispose the heat sink fan on a fixed frame, comprising:

a jointing part, having two flexible ends disposed on opposite sides of the jointing part which extend along the length of the jointing part, the two flexible ends providing the jointing part with a deformation range, at least one of the flexible ends having a guide slot for providing a flexible space when the jointing part is pressed;

an operating part, formed by extending and bending one side of the jointing part, and having a gap opened for providing a supporting and holding space; and a plurality of fastening pins, formed by extending the jointing part, and disposed with a protruding shaft for being hooked at an assembly hole corresponding to the heat sink fan.

2. The assembling member as claimed in claim 1, wherein the assembling member is made of a plastic material.

3. The assembling member as claimed in claim 1, wherein the jointing part is a plate-shaped structure.

4. The assembling member as claimed in claim 1, wherein the operating part has two symmetric grooves at two side-cutting edges respectively, and the grooves are contracted towards the direction of the jointing part to form a neck portion.

5. The assembling member as claimed in claim 4, wherein the neck portion is further disposed with an embedded block corresponding to one side of the fixed frame, for being embedded into an embedded hole of the fixed frame.

6. The assembling member as claimed in claim 1, further comprising a display lamp socket disposed on one side of the jointing part for accommodating a display lamp of the heat sink fan.

* * * * *